United States Patent [19]

Gardner et al.

[11] 4,293,090

[45] Oct. 6, 1981

[54] CONTAINER SEAM

[75] Inventors: Roland C. Gardner, Doylestown, Pa.; Ronald Mortellito, Monmouth Junction, N.J.

[73] Assignee: Clevepak Corporation, White Plains, N.Y.

[21] Appl. No.: 135,146

[22] Filed: Mar. 28, 1980

[51] Int. Cl.[3] ..... B65D 6/34; B65D 3/10

[52] U.S. Cl. ..... 229/5.6; 220/67

[58] Field of Search ..... 229/5.6, 5.5; 220/67, 220/66, 77

[56] References Cited

U.S. PATENT DOCUMENTS

| | | | |
|---|---|---|---|
| 2,237,809 | 4/1941 | Bronson | 229/5.6 X |
| 2,362,846 | 11/1944 | O'Brien | 220/67 |
| 2,382,378 | 8/1945 | Bloedorn | 220/67 X |
| 3,367,533 | 2/1968 | Baker | 220/67 |
| 3,376,997 | 4/1968 | Kutka | 220/67 X |
| 3,952,677 | 4/1976 | Hartman et al. | 220/67 X |

FOREIGN PATENT DOCUMENTS

| | | | |
|---|---|---|---|
| 579148 | 7/1958 | Italy | 229/5.6 |
| 96609 | 1/1961 | Netherlands | 229/5.6 |
| 22535 | 10/1907 | United Kingdom | 229/5.6 |

*Primary Examiner*—Davis T. Moorhead

*Attorney, Agent, or Firm*—Cushman, Darby & Cushman

[57] ABSTRACT

A container seam includes an additional vertical section of metal and a corrugated outer surface for providing sufficient vertical seam strength to resist the crushing force exerted by an opener drive gear. An end member is provided with an overhang having a segment thereof folded back parallel upon another segment of the overhang. After a seaming process, the folded segments are vertically oriented and provide increased vertical strength. During said seaming process, the outside part of the seam is provided with vertical corrugations to further increase vertical strength.

6 Claims, 5 Drawing Figures

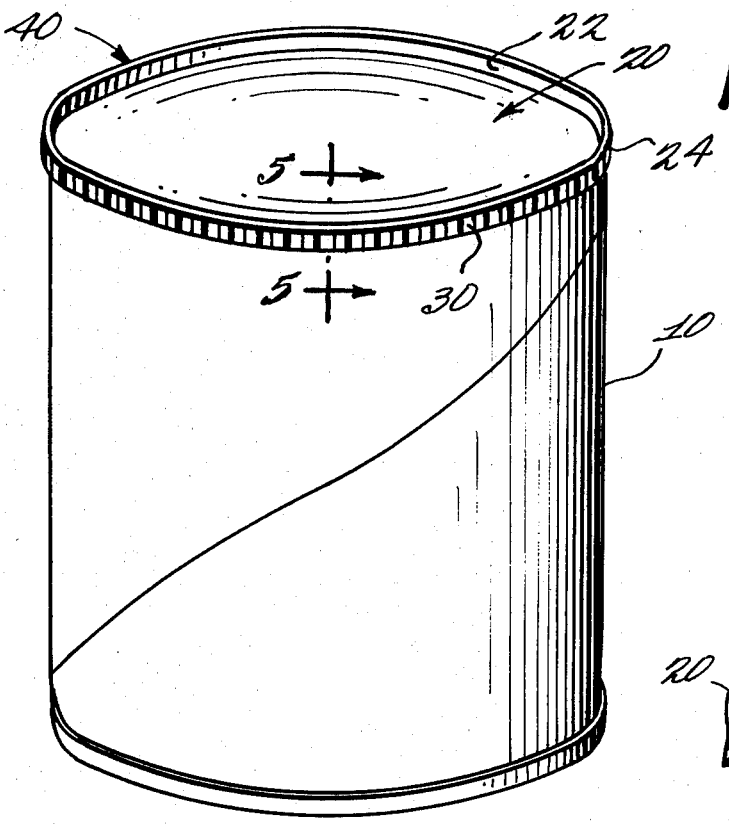
FIG. 1
FIG. 2
(PRIOR ART)
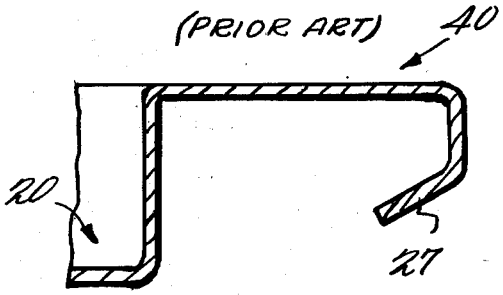
FIG. 3
(PRIOR ART)
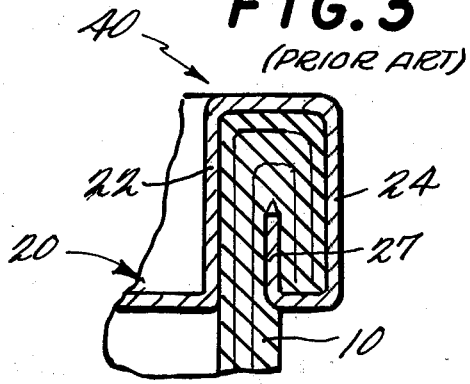
FIG. 4
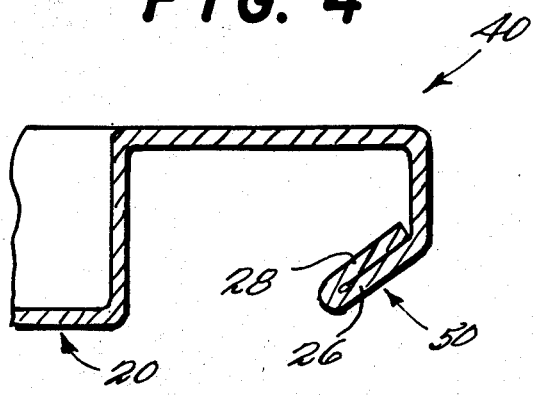
FIG. 5
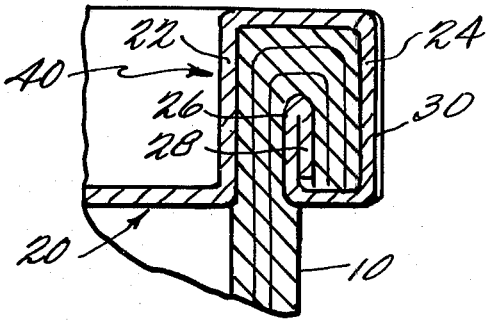

CONTAINER SEAM

BACKGROUND OF THE PRESENT INVENTION

This invention relates to an improved container seam, and more particularly to an improved can seam for facilitated opening of cans with mechanical can openers.

Container seams have been known in the art for quite some time. The metal ends of containers typically have an overhang which during the seaming operation engages the wall of the container and is folded to seal the container. Examples of a prior art container end before and after seaming are shown in FIGS. 2 and 3, respectively. In this prior art seam, it is possible for an opener drive gear to crush the seam, thereby essentially digging itself into a hole from which it often cannot disengage. The prior art seam does not have the vertical strength to resist the crushing force of the opener drive gear. Thus, there is need in the art for a can seam which resists the crushing force of a can opener drive gear.

Accordingly, it is an object of this invention to provide an improved container seam for strengthening the seam in a vertical direction in order to facilitate the opening of the container.

SUMMARY OF THE PRESENT INVENTION

The preferred and exemplary embodiment of the present invention overcomes the disadvantages in the prior art mentioned above. The container seam of the present invention includes an additional vertical section of metal for providing a strengthened structure. In addition, the outside surface of the container seam is corrugated during the seaming process for providing additional vertical strength. A container seam having the improvements effectively resists the crushing force exerted by openers having drive gears which engage the seam.

BRIEF DESCRIPTION OF THE DRAWINGS

Other objects, features and advantages of the present invention will become more fully apparent from the following detailed description of the preferred embodiments, appended claims and the accompanying drawings.

In the drawings, where like numbers indicate like parts,

FIG. 1 is a perspective view of the preferred embodiment of the present invention;

FIG. 2 is a section view of a can end prior to seaming having a prior art overhang;

FIG. 3 is a section view of a sealed can incorporating a prior art seam;

FIG. 4 is a section view of a can end of the preferred embodiment prior to seaming having an extended folded overhang; and FIG. 5 is a section view of the preferred embodiment incorporating the improved seam.

DETAILED DESCRIPTION OF THE PREFERRED EMBODIMENT

The preferred embodiment of the present invention is illustrated by way of example in FIGS. 1, 4 and 5. With specific reference to FIGS. 1 and 5, a container wall 10 is formed into preferably a cylindrical shape having an internal space with openings at both ends. Focussing on an end opening, an end member 20 is inserted into the opening for sealing the can. The end member 20 has a part 40 thereof (see FIG. 4) which engages container wall 10 at the opening. The part 40 is folded during the seaming operations to form the improved seam of the present invention.

With reference to FIG. 4, the part 40 has an overhang 50 which consists of segments 26 and 28 formed prior to seaming by folding back the overhang 50 parallel to itself. The relationship of the overhang 50 and segments 26 and 28 thereof after seaming is clearly shown in FIG. 5. With reference to FIG. 5, segments 26 and 28 of the overhang 50 are sandwiched between parts of the container wall 10. That structure is in turn sandwiched between an inside part 22 and an outside part 24 of the end member 20. The segments 26 and 28, the outside part 24 and the inside part 22 are cylindrical in shape and have axis that are coextensive with the axis of rotation of the container wall 10. The seam is thereby reinforced with an added vertical section of metal.

In order to provide additional vertical strength, the outside part 24 of the seam is vertically corrugated on the outside thereof. With reference to FIGS. 1 and 5, vertical corrugations 30 are provided in a seaming operation, preferably by the use of knurled tool having straight fine teeth which are oriented parallel to the axis of rotation of the container wall 10. The knurled tool is forced against the outer edge of outside part 24, whereby parts of the metal which comprises the outer edge of outside part 24 are compressed to form the corrugations 30.

In the preferred embodiment of FIGS. 1 and 5, the container wall 10 is formed of preferably fibrous material. The seam height is preferably 0.125" and the seam width is preferably 0.076". The end member is preferably a standard ETP can end modified to incorporate the improvement of the present invention.

The present invention provides an improved seam which resists the crushing force exerted by the drive gear of mechanical openers of types commonly used to open sealed cans. The can seam of the preferred embodiment of the present invention has an additional metal segment and vertical corrugations in order to provide this increased strength. Thus, the present invention has the important advantage of providing additional strength in order to improve the openability of cans and other containers.

While the invention has been described in connection with what is presently conceived to be the most practical and preferred embodiment, it is to be understood that the invention is not limited to the disclosed embodiment. There may be other embodiments, modifications, and equivalent arrangements included within the spirit and scope of the appended claims, which are to be accorded the broadest interpretation necessary to encompass all equivalent structures.

What is claimed is:

1. A sealed container having primary container wall means for defining an internal space and an opening at least at one end thereof, edge means extending about the opening at said at least one end for cooperating with an end closure for forming a seam about the opening; an end closure for closing the opening at said at least one end and forming together with said edge means a seal sealing said container, said end closure having a substantially planar central section and a crimpable sealing periphery, said periphery having an outer reinforced area extending about said end closure in a predetermined area, said seam having a vertically extending outer wall, said outer wall containing a plurality of spaced apart vertically extending reinforcing grooves extending around the entire outer wall and across the height thereof.

2. A container as in claim 1 wherein the plurality of reinforcing grooves are uniformly spaced from one another.

3. A sealed container having primary wall means defining an internal space and at least one opening at one end thereof, edge means extending about said at least one opening for cooperating with an end closure for forming a seam therewith extending about said at least one opening; an end closure for closing said at least one opening, said end closure including first reinforcing means for reinforcing the outer peripheral edge of said end closure so that said first reinforcing means is positioned centrally within the seam formed between said edge means and said end closure, and second reinforcing means for reinforcing the entire outer peripheral surface of the completed seam formed between said end closure and said edge means.

4. A sealed container as in claim 3 wherein said outer peripheral surface of the seam is comprised of a vertically extending outer wall.

5. A sealed container as in claim 4 wherein said first reinforcing means comprises a wall formed from a predetermined portion of the outer edge of said end closure which is folded back on itself to form a double wall thickness area extending inwardly a predetermined distance from and about the outer periphery of said end closure and wherein said second reinforcing means comprises a plurality of spaced apart vertically extending grooves extending across the height of said outer wall.

6. A sealed container as in claim 5 wherein said grooves are spaced apart a uniform distance.

* * * * *